United States Patent [19]

Grosjean

[11] 4,397,684

[45] Aug. 9, 1983

[54] PROCESS FOR PNEUMATIC STIRRING OF A BATH OF MOLTEN METAL

[75] Inventor: Jean-Claude Grosjean, Semecourt, France

[73] Assignee: Institut de Recherches de la Siderurgie Francaise Irsid, Saint-Germain-en-Laye, France

[21] Appl. No.: 354,912

[22] Filed: Mar. 4, 1982

[30] Foreign Application Priority Data

Mar. 11, 1981 [FR] France ..... 81 05017

[51] Int. Cl.[3] ..... C21C 5/34; C21C 7/10

[52] U.S. Cl. ..... 75/59

[58] Field of Search ..... 75/59, 60

[56] References Cited

U.S. PATENT DOCUMENTS 3,640,702 2/1972 Karinthi ..... 75/53
3,817,744 6/1974 Leroy ..... 75/60
3,854,932 12/1974 Bishop ..... 75/49
4,369,060 1/1983 Metz ..... 266/218

*Primary Examiner*—Peter D. Rosenberg
*Attorney, Agent, or Firm*—Michael J. Striker

[57] ABSTRACT

A process of pneumatic stirring of a bath of molten metal according to which a stirring fluid is injected through permeable refractory elements arranged at the bottom of a crucible containing the bath, in which the used stirring fluid is, at least temporarily, an organic liquid such as hydrocarbon.

The process is advantageously used on a bath of molten pig iron during refining of the same by oxygen, and in which the organic liquid is replaced immediately after decarburization of the bath by an inert gas such as argon or nitrogen.

The process thus permits an efficient stirring of the bath of molten metal without the risk of polluting the metal either by hydrogen or nitrogen.

6 Claims, 1 Drawing Figure

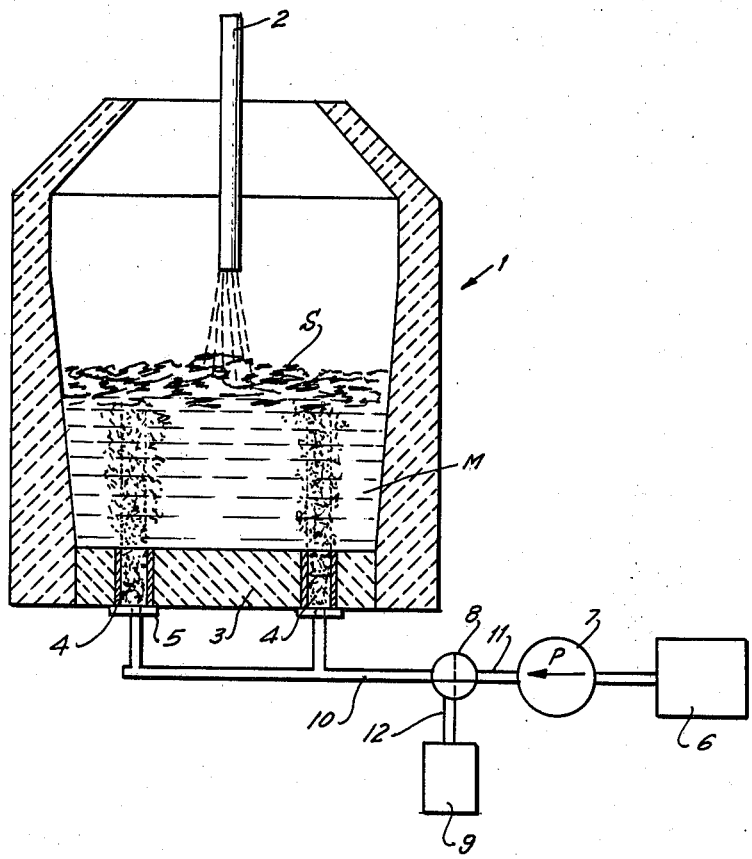
2
1
S
M
4
5
3
4
8
11
7
P
10
12
6
9

PROCESS FOR PNEUMATIC STIRRING OF A BATH OF MOLTEN METAL

BACKGROUND OF THE INVENTION

The present invention relates to a process of pneumatic stirring of a bath of molten metal. More particularly, the present invention relates to stirring of a bath of molten pig iron during refining of the same in a converter by oxygen blown from above onto the bath.

It is known during a refining process of a bath of molten metal by blowing oxygen to the top of the bath to stir the latter by means of a gaseous fluid injected through refractory gas-permeable elements at the bottom of the converter into the bath (French Utility Pat. No. 2,322,202 to IRSID, and Luxembourg Pat. No. 42,419 to CNRM).

The gaseous fluid is usually an inert gas, such as argon or preferably nitrogen, due to the small cost of the latter.

This new technique, which is known in the world as the "LBE process" (Lance-Bubbling-Equilibrium) tends, as its name indicates, to realize an equilibrium between the metal and the slag, thus permitting combining of the respective advantages of the classical refining process by blowing oxygen from the top and by blowing oxygen from the bottom. This technique provides especially a better control of the refining operation, by assuring a greater flexibility as to the choice of the moment, the duration, or to a certain extent the intensity, of the gaseous injection.

This process has, however, certain technological restrictions which limit the possibility to introduce through each element such a large quantity of gas as is desired.

It has therefore already been proposed to replace the stirring gas to be injected by a liquefied gas which vaporizes upon contact with the bath of molten metal. In this way it is possible to obtain, per injection unit, a greater volume of stirring gas than before. (French Pat. No. 2,463,054 to IRSID, corresponding to U.S. Pat. No. 4,340,208.)

Nevertheless, it has been ascertained that, depending upon the type of permeable elements used, the same stand up only more or less to the thermal shocks caused by the repeated injections of cryogenic fluids.

SUMMARY OF THE INVENTION

It is therefore an object of the present invention to provide for a process of pneumatic stirring of a bath of molten metal with a considerable output of stirring gas, while avoiding the difficulties encountered in known processes.

With this and other objects in view, which will become apparent as the description proceeds, the present invention relates to a process for pneumatic stirring during a certain period a bath of molten metal in a crucible, and comprising the steps of injecting a stirring fluid through elements of permeable refractory material at the bottom of the crucible into the bath of molten metal, wherein the stirring fluid injected through the elements consists at least during part of the stirring period exclusively of an organic liquid, such as a hydrocarbon, or preferably a mixture of hydrocarbons.

The term "liquid" is to be understood as an organic fluid in liquid state under standard conditions of temperature and pressure, or easily liquefiable under small pressure, possibly under a pressure inferior to the injection pressure in the permeable elements (about 3 to 6 bar). In the case of the most commonly used aliphatic saturated hydrocarbons, it concerns therefore hydrocarbons of the family $C_nH_{4n}$ where n is greater than 2 (propane, butane, etc).

In this way, one takes advantage resulting from the injection of a stirring fluid in liquid state into the bath without subjecting the permeable refractory element to thermic shocks reducing their useful life.

It is further possible, according to a preferred variation of the process according to the present invention, to eliminate this risk in a simple manner, by preheating the organic liquid before its injection.

Furthermore, the process according to the present invention provides for additional advantages, among which the following are mentioned:

A protection of the permeable refractory element and the regions adjacent thereto by the deposit of a layer of carbon resulting from the decomposition of the organic liquid injected; and the absence of any risk of nitridation of the bath.

The difficulties encountered to eliminate nitrogen from a metallic bath stirred by means of nitrogen are well known.

It has, however, to be mentioned that the use of an organic liquid may result in a certain hydrogenation of the bath which, in certain cases, may be undesirable.

According to one concept of the method according to the present invention, it is possible to overcome this difficulty.

Thus, the process is started by injecting a stirring fluid constituted by an organic liquid, for instance propane, into the bath of molten metal, and then, after a certain time before the desired end of the stirring process, for instance a few minutes before the end, the organic liquid is replaced by an inert gas, such as nitrogen or argon, holding thereby the maximum admissible nitrogen content to a minimum.

In this way, the stirring by means of an inert gas produces a "washing" of the bath of molten metal, which is thereby freed of dissolved hydrogen accumulating during the initial mixing by injection of an organic liquid.

This particular manner of carrying out the method according to the present invention is especially advantageous for the refining of pig iron by oxygen with a stirring of the bath with argon or nitrogen.

In this case, the moment in which one passes from the injection of an organic liquid to injection of nitrogen must be as early as possible after the end of the decarburization of the bath of molten pig iron. Indeed, it is only at the end of the decarburization period, in which the metallurgical conditions for solution of nitrogen become clearly unfavorable, so that the choice of this element as stirring gas after the decarburization of the bath will not produce an excessive nitridation of the latter, at least not beyond usually acceptable tolerances.

In this manner of carrying out the invention, the process according to the present invention will therefore provide an efficient stirring of the bath during the refining process without risking pollution of the metal with hydrogen or nitrogen.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing schematically illustrates in cross section a crucible or converter especially for refining pig iron according to the process of the present invention.

DESCRIPTION OF A PREFERRED EMBODIMENT

Referring now to the drawing, which shows an arrangement for carrying out the process of the present invention comprising a crucible or converter 1 containing a bath of molten metal M covered by a layer of slag S onto which oxygen is blown through a lance 2. A plurality of permeable refractory elements 4 extend in vertical direction through the bottom 3 of the converter, and connected to the bottom surface of the bottom 3 by holding plates 5.

The arrangement furthermore includes a reservoir 6 for an organic liquid, which communicates over a conduit 11 in which a pump 7 and a two-position valve 8 are arranged with a conduit 10 connected by branches extending through the plates 5 with the elements 4, while a reservoir 9 containing a neutral gas under pressure, such as argon or nitrogen, likewise communicates with the two-position valve 8.

The bath of molten metal in the converter is preferably pig iron which is refined by blowing oxygen through the lance 2 onto the top of the bath, and during this refining process the valve 8 is held in the position shown in the drawing so that organic liquid is fed at a certain pressure by means of the pump 7, the conduit 11, the valve 8 and the conduit 10 through the elements 4 of permeable refractory material upwardly through the molten bath of pig iron. At the end of the decarburization of the bath of molten pig iron, the valve 8 is turned through 90° so that now an inert gas from the container 9 is passed through the conduits 12 and 10 and injected through the elements 4 upwardly through the bath.

It will be understood that each of the elements described above, or two of more together, may also find a useful application in other types of processes for pneumatic stirring of a bath of molten metal differing from the types described above.

While the invention has been illustrated and described as embodied in a process for refining a bath of molten pig iron by blowing oxygen from the top onto the bath while injecting an organic liquid through elements of permeable refractory material in the bottom of the converter upwardly through the bath and by replacing the organic liquid by an inert gas immediately at the end of the decarburization of the bath of molten pig iron, it is not intended to be limited to the details shown, since various modifications and procedural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential, characteristics of the generic or specific aspects of this invention.

What is claimed as new and desired to be protected by Letters Patent is set forth in the appended claims:

1. A process for pneumatic stirring during at least a part of a refinement period of a bath of molten metal in a crucible comprising the steps of injecting a stirring fluid through elements of permeable refractory material wherein the stirring fluid injected through the elements consists of an organic liquid which vaporizes upon contact with the molten metal.

2. A process as defined in claim 1, wherein the stirring fluid is a liquid hydrocarbon.

3. A process as defined in claim 1, wherein a short time before the end of the stirring period said organic liquid is replaced by an inert gas.

4. A process as defined in claim 3, wherein said inert gas is argon.

5. A process as defined in claim 3, wherein said inert gas is nitrogen.

6. A process as defined in claim 3, wherein said bath of molten metal is a bath of molten pig iron, and including the step of blowing oxygen from the top onto the bath to decarburize the latter while injecting said organic liquid through said elements and replacing said organic liquid by said inert gas immediately at the end of the decarburization of the molten pig iron.

* * * * *